US007810203B2

(12) United States Patent
Stoltz

(10) Patent No.: US 7,810,203 B2
(45) Date of Patent: Oct. 12, 2010

(54) DRAIN CLEANING APPARATUS

(75) Inventor: David Stoltz, Ballwin, MO (US)

(73) Assignee: Stoltz & Murphy, Inc., Manhattan, KS (US)

( * ) Notice: Subject to any disclaimer, the term of this patent is extended or adjusted under 35 U.S.C. 154(b) by 1035 days.

(21) Appl. No.: 11/548,793

(22) Filed: Oct. 12, 2006

(65) Prior Publication Data

US 2008/0086803 A1 Apr. 17, 2008

(51) Int. Cl.
*B08B 9/04* (2006.01)

(52) U.S. Cl. ..... 15/104.33; 4/255.01; 4/255.04; 4/255.06

(58) Field of Classification Search ..... 15/104.05, 15/104.31, 104.33; 4/255.01, 255.04, 255.06; 134/167 R, 168 R, 166 C, 167 C
See application file for complete search history.

(56) References Cited

U.S. PATENT DOCUMENTS 3,372,417 A * 3/1968 Devine ..... 15/104.33
3,897,601 A * 8/1975 Wusterfeld ..... 4/255.04
5,107,550 A * 4/1992 Hawro ..... 4/255.08
5,682,620 A 11/1997 Stoltz et al.
6,098,212 A * 8/2000 Rogan ..... 4/255.04
6,594,849 B1 * 7/2003 Nimens ..... 15/104.33

* cited by examiner

*Primary Examiner*—Mark Spisich
(74) *Attorney, Agent, or Firm*—Hovey Williams LLP

(57) ABSTRACT

An improved drain cleaning assembly (10) is provided having a coupling apparatus (18) designed to mate with the open end of a clogged drainpipe (12), an elongated, powered, axially-rotatable drain cable (16) passing through the apparatus (18) and into pipe (12), and water inlet and outlet lines (20, 26) coupled with apparatus (18) for delivery of water therethrough during the course of drain cleaning operations. The apparatus (18) includes a unitary main tubular body (38) receiving a drainpipe connection fitting (46) via quick-connect structure (44). The body (38) also has an internal sponge-type cable cleaning component (94) and a spray fitting (54) for directing incoming water onto cable (16). Preferably, the lines (20, 26) are each equipped with a check valve (21, 28) to control water flow through body (38) during drain unclogging and to facilitate visual verification of an unclogged condition. The inlet line (20) may also have a dispenser (24) for cleaning agent(s) such as soap, sanitizer and/or disinfectant liquids, so as to cleanse the cable (16) upon removal thereof.

8 Claims, 3 Drawing Sheets

16
104
38
100
98
102
18
20
26
40
42
44
46
48
50
52
54
55
56
58
60
62
64
66
68
70
72
74
76
78
80
82
84
86
88
90
92
94
96
106
108
110
112
5.
6.

DRAIN CLEANING APPARATUS

BACKGROUND OF THE INVENTION

1. Field of the Invention

The present invention is broadly concerned with improved apparatus for use by plumbers to facilitate unclogging of pipes, e.g., in hospitals, manufacturers, or other commercial contexts or in household drainpipes. More particularly, the invention pertains to such apparatus including an elongated, tubular main body adapted for coupling to the open end of a clogged pipe, and permitting passage therethrough of an elongated, powered, axially-rotated drain cable. The tubular main body is advantageously equipped with water inlets and outlets, a sponge-type cable cleaning component, an internal cable spray fitting, and a reservoir for holding cleaning, sanitizing, and/or disinfecting liquids used to clean the drain cable as it clears a clog or is removed. A drainpipe connection fitting is preferably coupled to the main body by means of a sturdy, quick-connect structure.

2. Description of the Prior Art

Clogged drains are a common and troublesome problem for many homeowners and businesses. The first response to a clogged drain is normally the use of harsh chemical drain cleaners which are poured into the drain in an attempt to clear the blockage. Often, repeated attempts using such chemicals are tried. If this is unsuccessful, the homeowner or business owner may then resort to water pressure-actuated devices attached to an adjacent faucet. In many cases, these expedients are successful; however, if the blockage is truly intractable, the only resort for most people is to call a professional plumber.

Most often, plumbers make use of an elongated, metallic, powered drain cables or "snakes" for drain cleaning. These conventional devices are fed into the open drainpipe and rotated by means of a remote electrical or mechanical motor. The rotating action of the drain cable is almost always successful in rapidly clearing the drain. A problem in the use of drain cables is that, upon withdrawal thereof from the drainpipe, the waste material contains water-born pathogens (e.g., viruses or bacteria) and vestiges of the previously used harsh chemicals. Often, these hazardous materials are sprayed onto adjacent cabinets or onto the plumbers themselves. This necessitates that the plumbers exercise extreme care when using drain cables, else they be contacted with the harsh and/or unhealthful materials from the cleared drainpipe that coat the snake. Another problem encountered in use of conventional drain cables is the difficulty of determining when the clog has been effectively cleared. One common approach is to pour water down the drainpipe, but this may require complete removal of the cable at successive intervals, and is thus time consuming.

In response to these problems, it has been suggested in the past to clean a cable with wiping or cleaning elements attached to devices positioned near a drain. For example, U.S. Pat. No. 2,222,191 describes a line cleaning device employing wiping elements which are designed to engage a cleaning cable or the like as it is being pulled from a well. U.S. Pat. No. 5,077,861 describes a hose cleaning device made up of a tubular hose-receiving body having internal brush elements. The '861 patent also discloses the use of a water inlet fitting allowing water to be introduced into the device to assist in hose cleaning. While these devices can be effective for cleaning of the drain cables, they provide no way of readily determining whether a given clog has been removed.

U.S. Pat. No. 5,682,620 (incorporated by reference herein) represents a distinct advance in this art, and provides a drain cable apparatus having a tubular main body made up of hinged, openable body halves and having internal sponge-type cable cleaning elements. However, the apparatus of the '620 patent can be somewhat time-consuming to install, requiring the use of several clamping rings to affix a resilient drainpipe sleeve and to close the two-piece main tubular body.

SUMMARY OF THE INVENTION

The present invention provides an improved apparatus for coupling with drainpipes to be cleared, of the type illustrated in U.S. Pat. No. 5,682,620. Broadly speaking, the coupling apparatus of the invention comprises a tubular body presenting a drainpipe connection end and a remote end, a water inlet, and a water outlet, with a drainpipe connector fitting detachably secured to the body adjacent the drainpipe connection end thereof and configured to communicate the interior of the body and the drainpipe. The tubular body includes a passageway in order to receive an elongated drain cable passing through the body and fitting into the drainpipe. A drain cable cleaner is also located within the body and operable to remove contaminants from the cable upon withdrawal thereof from the drainpipe.

In preferred forms, quick-connect structure is provided to facilitate rapid attachment and detachment of the drainpipe connector fitting from the tubular body of the apparatus. Such quick-connect structure may include a plurality of connector balls carried by the tubular body, with a mating peripheral groove on the drainpipe connector fitting. A spring-loaded biasing member is operable to urge the connector balls into the peripheral groove in order to maintain the drainpipe connector fitting in place.

The drain cable cleaner is preferably in the form of an annular sponge element located within the body and receiving the drain cable. Compression structure is provided to place the sponge element in axial compression within the body and to allow periodic take-up as the sponge element wears. Additional drain cable cleaning is provided by means of a spray fitting within the body, including a plurality of spray orifices for directing incoming water onto the drain cable. Also, an inlet is preferably used to introduce cleaning or sanitizing liquids into the main body to clean the internal components thereof and the cable.

These and other important aspects of the present invention are described more fully in the detailed description below.

Figure 1:
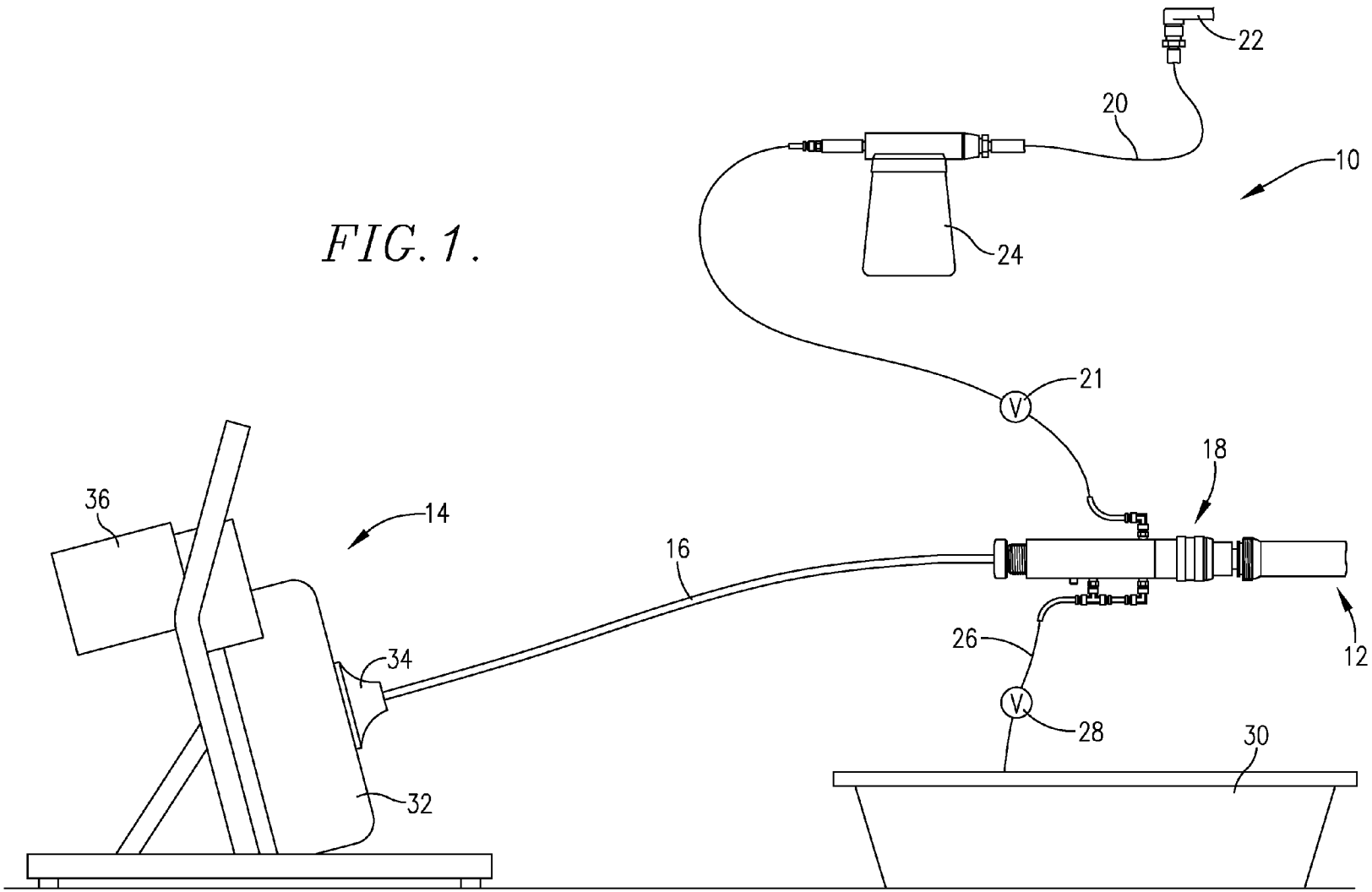
FIG. 1 is a somewhat schematic elevational view illustrating the drain cable coupling apparatus of the invention, in use during clearing of a clogged drain.

The drawing figures do not limit the present invention to the specific embodiments disclosed and described herein. The drawings are not necessarily to scale nor inclusive of the many variations in size and design required to meet multiple residential, industrial, and/or commercial applications.

Accordingly, emphasis is instead placed upon clearly illustrating the principles of the invention.

DETAILED DESCRIPTION OF THE PREFERRED EMBODIMENT

Turning now to the drawings, a drain clearing assembly 10 designed to clear clogs within a drainpipe 12 is illustrated in FIG. 1. The assembly 10 broadly includes a motorized, cable-type drain clearing device 14 including an elongated, axially-rotatable, metallic drain cable 16, coupling apparatus 18 designed to mate with the open end of drainpipe 12, a water inlet line 20 having a check valve 21 and adapted for coupling with a faucet 22. an in-line reservoir or dispenser 24 for soap, sanitizer, and/or disinfectant liquids, a water outlet line 26 equipped with check valve 28, and a wastewater collection tub 30 or a drain. As illustrated, the coupling apparatus 18 is of generally tubular design and is constructed so as to receive cable 16, which passes into drainpipe 12. Additionally, the water lines 20 and 26 are coupled with the apparatus 18 for passage of water and soap or other cleaning solution therethrough during drainpipe cleaning operations. Alternately, the assembly 10 maybe used without the soap dispenser 24. Although not shown, body 18 may be supported on lower-engaging leg or stand structure that can be adjusted both vertically and horizontally to provide additional support during clog-clearing applications.

The drain clearing device 14 is entirely conventional and includes a cable housing 32 having a cable outlet 34, as well as a drive motor 36 operable to axially rotate the cable 16 during drain clearing operations. As is well understood in the art, the cable 16 is fed into drainpipe 12 and may include a cutter or head at the forward end thereof, to assist in clearing drain clogs.

Figures 2, 3:
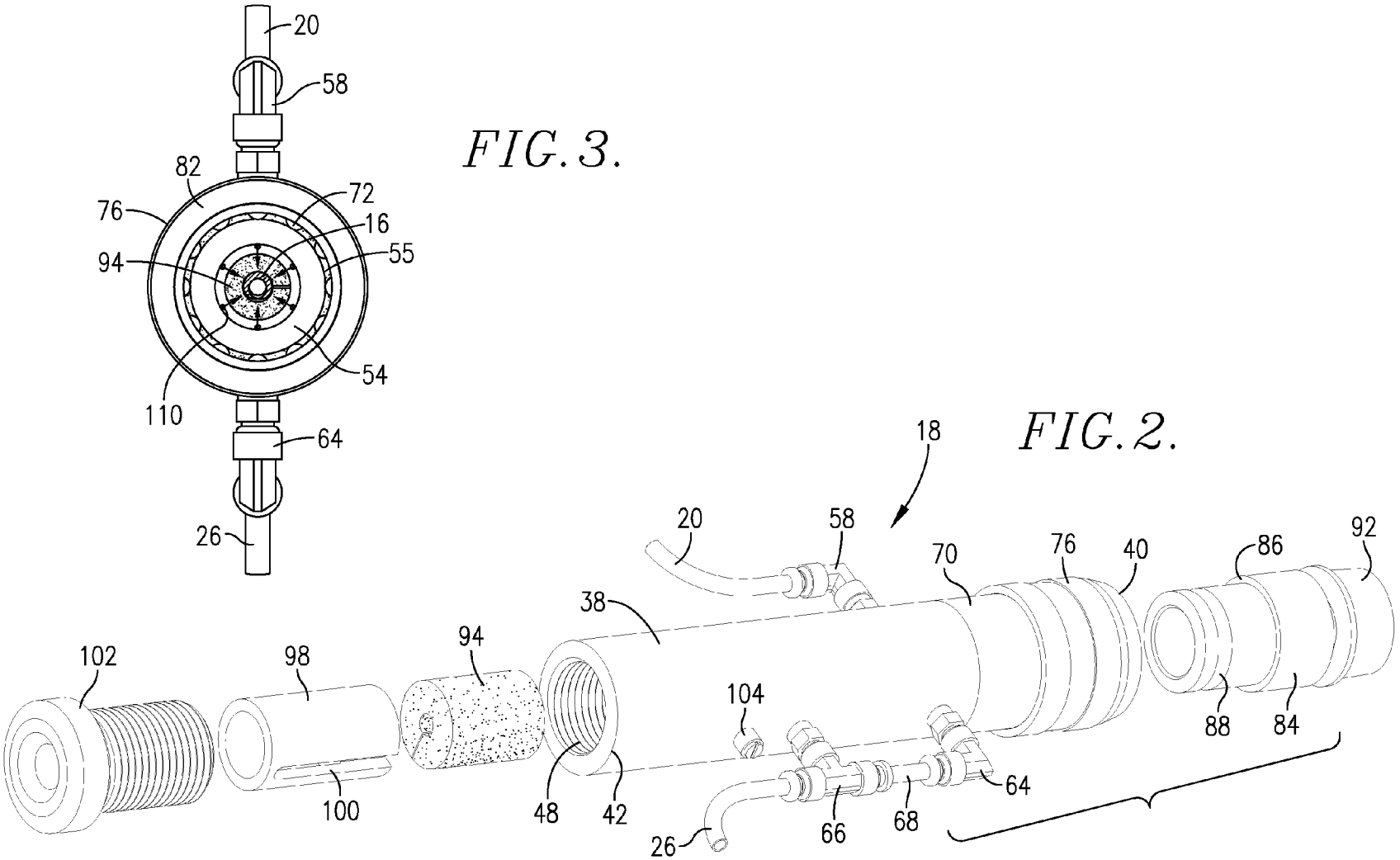
FIG. 2 is an exploded perspective view of the coupling apparatus.
FIG. 3 is an end view of the coupling apparatus.
Figures 4, 5, 6:
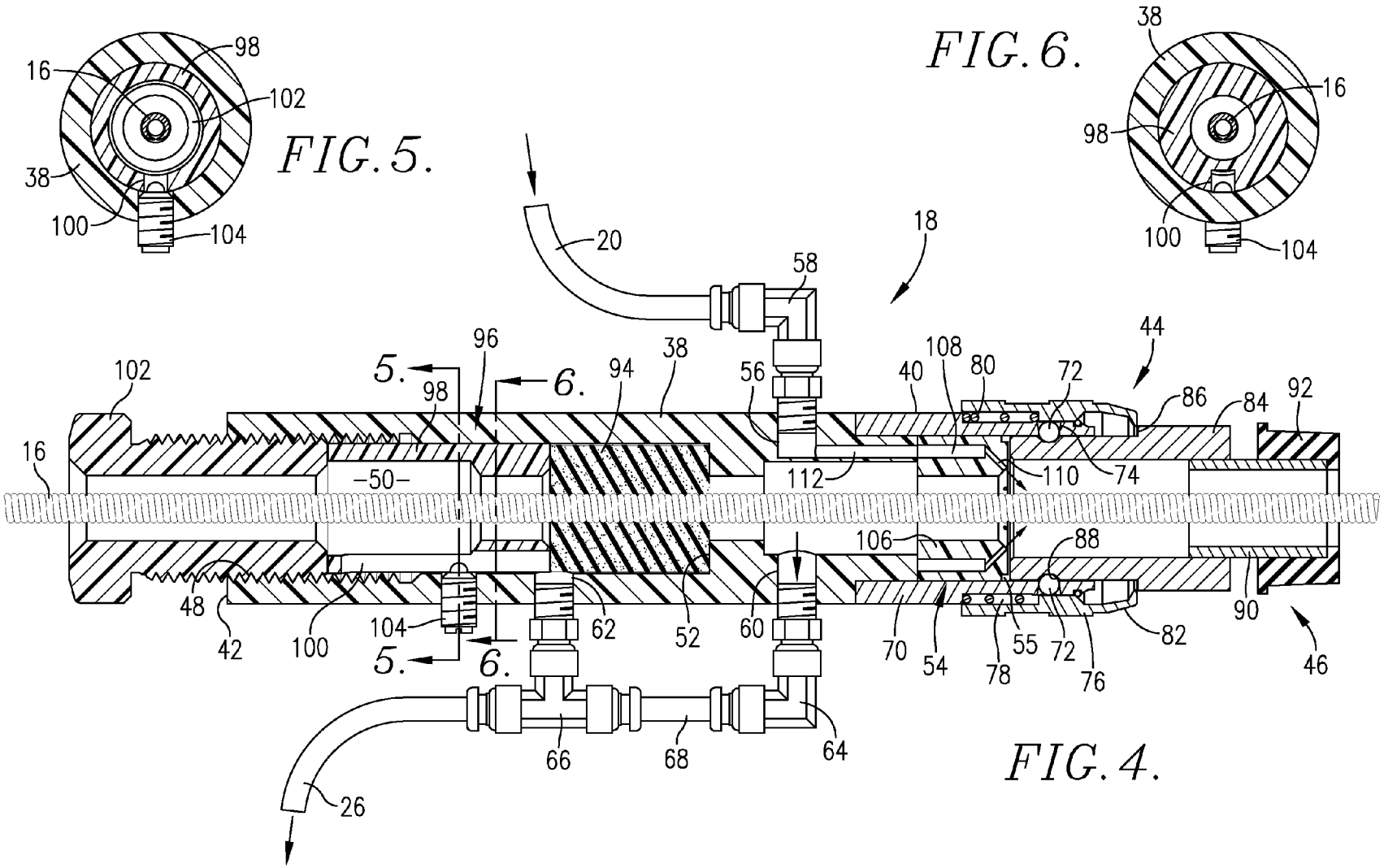
FIG. 4 is a vertical sectional view of the coupling apparatus.
FIG. 5 is a vertical sectional view taken along line 5-5 of FIG. 4.
FIG. 6 is a vertical sectional view taken along line 6-6 of FIG. 4.

The coupling apparatus 18 is best illustrated in FIGS. 2 and 4 and includes a unitary, tubular main body 38 having a drainpipe connection end 40 and a remote end 42. The body 38 may be formed of metal, appropriate synthetic resin material, or any other suitable material. The connection end 40 has quick-connect structure 44 designed to permit quick attachment and detachment of a drainpipe connection fitting 46. The remote end 42 is internally threaded as at 48. Internally, the body 38 has an elongated, axially-extending passageway 50 with an inwardly-extending, central shoulder section 52, and a forward, press-fitted spray fitting 54 equipped with optional O-ring 55. A water inlet port 56 is provided adjacent shoulder section 52, and has a conventional elbow-type threaded coupler 58 therein. A pair of opposed water outlet ports 60, 62 are also provided, with port 60 having an elbow-type threaded coupler 64 therein, where as port 62 is equipped with a threaded T-coupler 66. Referring to FIG. 4, it will be noted that the water inlet 20 is attached to coupler 58, while outlet line 26 is attached to T-coupler 66. A short connector tube 68 operatively interconnects the connectors 64, 66.

The quick-connect structure 44 includes a tubular base 70 secured to the outer surface of body 38 adjacent end 40. The base 70 has a plurality of captively-retained connector balls 72 located within a circumferential slot 74. Additionally, the structure 44 has a spring-loaded, axially-shiftable biasing member 76 disposed about the forward end of body 70. The member 76 has an internal, circumferential relief 78 housing a coil spring 80, as well as a forwardly-extending segment 82. When the member 76 is positioned as illustrated in FIG. 4, the member 76 serves to inwardly bias the balls 72 for connection purposes. On the other hand, when the member 76 is manually withdrawn leftwardly, as viewed in FIG. 4, the bias upon the balls 72 is relieved. Of course, the spring 80 serves to urge the member 76 towards the FIG. 4 position thereof.

The connection fitting 46 includes an elongated, tubular element 84 having an annular shoulder 86 as well as a peripheral, circumferentially-extending connection groove 88. The element 84 has an inner, tubular, optionally threaded connector 90 fixedly secured within the bore thereof and supports an outboard, resilient drainpipe grommet 92. Again referring to FIG. 4, it will be observed that the connection fitting 46 may be operatively attached to main body 38 through use of the quick-connection structure 44. That is to say, when it is desired to attach the fitting 46, the biasing member 76 is withdrawn leftwardly, as shown in FIG. 2, and the element 84 is inserted within the open end of the body 38 until the inner end of the member 76 bottoms out against fitting 54 and O-ring 55. Release of the member 76 causes the latter to be moved rightwardly under the influence of spring 80, until the segment 82 engages shoulder 86 and the balls 72 are biased inwardly into groove 88. Reversal of this procedure allows the fitting 46 to be removed from the main body 38. It will be appreciated that the structure 44 allows attachment and detachment of the fitting 46 without the use of any tools.

The main body 38 is equipped with an internal cable cleaner, preferably in the form of an annular sponge-like component 94. The component 94 abuts shoulder section 52 (FIG. 4) and is placed in axial compression by means of structure 96 including a tubular, component-engaging spacer 98 having an axial slot 100, and an endmost, threaded, tubular compression cap 102 engaging the end of spacer 98 remote from component 94. The spacer 98 is maintained in position within body 38 by means of detent screw or alignment pin 104 extending through the sidewall of body 38 and into slot 100.

The spray fitting 54 includes a generally annular body 106 having a circumferentially-extending passageway 108 as well as six obliquely-oriented orifices 110 in communication with passageway 108. The passageway 108 in turn communicates with water inlet 56 via axial conduit 112 within main body 38.

It will be observed that the water outlets 60 and 62 are located on opposite sides of shoulder section 52, so that the outlet 60 is to the right of component 94, whereas outlet 62 is leftward of shoulder section 52 and adjacent the component 94. Further, the axial passageway 50 for cable 16 includes, in serial order, cap 102, spacer 98, component 94, spray fitting 54, element 84, connector 90, and grommet 92.

In use, an appropriate connection fitting 46 with a properly sized grommet 92 is inserted into main body 38 by means of the quick-connect structure previously described. Next, the cable 16 is threaded through apparatus 18, and specifically through the passageway 50 thereof, whereupon a cable cutter or other tool (not shown) may be installed on the forward end of cable 16. The cable 16 can either be threaded through previously assembled apparatus 18, or through the individual components thereof, followed by assembly of the apparatus 18. The water inlet line 20 and outlet line 26 are also installed onto the appropriate connectors 58 and 66, with the outlet line 26 delivering into container 30.

At this point, the apparatus 18 is installed in the open end of drainpipe 12 by pressing grommet 92 into the drainpipe using hand pressure, with the cable 16 passing into the drainpipe. If desired, the apparatus 18 may be mounted on appropriate holding or mounting structure (not shown) to eliminate the need for manual manipulation of the apparatus. Water is then passed through the apparatus 18 from faucet 22 or other suitable source, with optional use of soap, sanitizer and/or disinfectant as may be desired from dispenser 24, and motor 36 is actuated to rotate cable 16 and facilitate extension thereof into drainpipe 12. During this operation, volumes of water from line 20 controlled by valve 21 pass into the confines of body 38 and through sponge component 94, exiting through the spray fitting 54 and/or dual outlets 60, 62 and line 26 into tub 30. While the drainpipe 12 remains clogged, the water from line 20 exits via line 26 to tub 30. Once the pipe is cleared, however, most if not all of this incoming water passes through the apparatus 18 and into the drainpipe 12. Thus, the user has a visual indication of success in clearing drainpipe 12, by observing that the water exiting line 26 diminishes to little or no water.

Additionally, during the operation of apparatus 18, incoming water delivered via inlet 56 passes through conduit 112 and oblique orifices 110 to direct a spray of water onto cable 16. This continues during the entire course of pipe-clearing operation, and during removal of cable 16. During this removal sequence, the sponge component 94 comes into play to wipe the cable 16 and remove surface contaminants. This ensures that the cable 16 does not spray dirt, caustic chemicals, and/or other unhealthful pathogens as it is removed from apparatus 18. Of course, it will be recognized that the apparatus 18 could be used without water flow therethrough, although this is not preferred.

During the course of multiple uses of apparatus 18, the sponge component 94 may become worn. Such wear can be taken up by rotation of compression cap 102, which moves spacer 98 rightwardly, as viewed in FIG. 4, to maintain axial compression on the component 94.

Although the invention has been described with reference to the preferred embodiment illustrated in the attached drawing figures, it is noted that equivalents may be employed and substitutions made herein without departing from the scope of the invention as recited in the claims. For example, the particular shape and size of the coupling apparatus 18 may be altered without departing from the scope of the invention. Having thus described the preferred embodiment of the invention, what is claimed as new and desired to be protected by Letters Patent includes the following:

The invention claimed is:

1. Apparatus for coupling with a drainpipe to be cleared and comprising:

a tubular body presenting a drainpipe connection end and a remote end, a water inlet, and a water outlet;

a drainpipe connector fitting;

a quick-connect structure comprising a plurality of connector balls operably coupled with said body adjacent said connection end thereof and operable to detachably secure said fitting to said body adjacent said drainpipe connection end thereof, said fitting including a peripheral groove detachably receiving said connector balls and configured to communicate the interior of the body and said drainpipe;

a passageway formed in said body in order to receive an elongated drain cable passing through the body and fitting into said drainpipe; and a drain cable cleaner located within said body and operable to remove contaminants from said cable upon withdrawal thereof from the drainpipe.

2. The apparatus of claim 1, including a spring-loaded biasing member operable to urge said balls into said groove.

3. The apparatus of claim 1, wherein the water inlet and the water outlet constitute a means for determining whether the drainpipe has been unclogged during use of the apparatus.

4. The apparatus of claim 3, including a valve operatively coupled with said inlet and said outlet, in order to control the flow of water into and out of said body during use of said apparatus.

5. Apparatus for coupling with a drainpipe to be cleared and comprising:

a tubular body presenting a drainpipe connection end and a remote end, a water inlet, and a water outlet;

a drainpipe connector fitting detachably secured to said body adjacent said drainpipe connection end thereof and configured to communicate the interior of the body and said drainpipe;

a passageway formed in said body in order to receive an elongated drain cable passing through the body and fitting into said drainpipe; and a drain cable cleaner located within said body and operable to remove contaminants from said cable upon withdrawal thereof from the drainpipe, said cleaner comprising an annular sponge element located within said body and receiving said drain cable, there being compression structure comprising a compression cap threadably coupled to said body adjacent said remote end thereof, and a spacer body between said cap and said sponge element, the compression structure for placing said sponge element in axial compression within said body.

6. The apparatus of claim 5, said cap and spacer body being tubular and configured to receive said drain cable.

7. Apparatus for coupling with a drainpipe to be cleared and comprising:

a tubular body presenting a drainpipe connection end and a remote end, a water inlet, and a water outlet;

a drainpipe connector fitting detachably secured to said body adjacent said drainpipe connection end thereof and configured to communicate the interior of the body and said drainpipe;

a passageway formed in said body in order to receive an elongated drain cable passing through the body and fitting into said drainpipe;

a spray fitting within said body and in communication with said water inlet, said spray fitting operable to spray incoming water onto said drain cable; and a drain cable cleaner located within said body and operable to remove contaminants from said cable upon withdrawal thereof from the drainpipe.

8. The apparatus of claim 7, said spray fitting being located adjacent said connection end of said body and having a plurality of circumferentially spaced apart water spray orifices oriented to spray said water on said cable.

* * * * *